US006626674B2

(12) United States Patent
Chudwin

(10) Patent No.: US 6,626,674 B2
(45) Date of Patent: Sep. 30, 2003

(54) GUN SAFETY AND MARKSMANSHIP TRAINING DEVICE AND METHOD FOR USING SAME

(76) Inventor: Jeffrey L. Chudwin, 246 Kansas, Frankfort, IL (US) 60423

( * ) Notice: Subject to any disclaimer, the term of this patent is extended or adjusted under 35 U.S.C. 154(b) by 0 days.

(21) Appl. No.: 09/832,655

(22) Filed: Apr. 11, 2001

(65) Prior Publication Data

US 2003/0022136 A1 Jan. 30, 2003

(51) Int. Cl.[7] ..... F41G 3/26
(52) U.S. Cl. ..... 434/16; 434/19; 42/70.01
(58) Field of Search ..... 434/16, 17, 24, 434/11; 89/137; 42/70.01, 70.02, 70.04; 446/473

(56) References Cited

U.S. PATENT DOCUMENTS

| | | | | | |
|---|---|---|---|---|---|
| 835,349 | A | * | 11/1906 | Deming | 42/70.01 |
| 3,708,901 | A | * | 1/1973 | Wolter | 42/70.01 |
| 4,412,397 | A | * | 11/1983 | Bayn | 42/70.01 |
| 5,412,959 | A | * | 5/1995 | Bentley | 70/30 |
| 6,250,008 | B1 | * | 6/2001 | Silver | 42/70.01 |

* cited by examiner

*Primary Examiner*—Kien T. Nguyen
(74) *Attorney, Agent, or Firm*—Wildman, Harrold, Allen & Dixon LLP; Thomas J. Ring

(57) ABSTRACT

A safety device for a firearm having a handle and a barrel. The safety device includes a gun-attachment member and a chamber-disabling component secured to the gun-attachment. A weight may also be added to the device to allow it to be used in marksmanship training.

72 Claims, 2 Drawing Sheets

FIG. 1
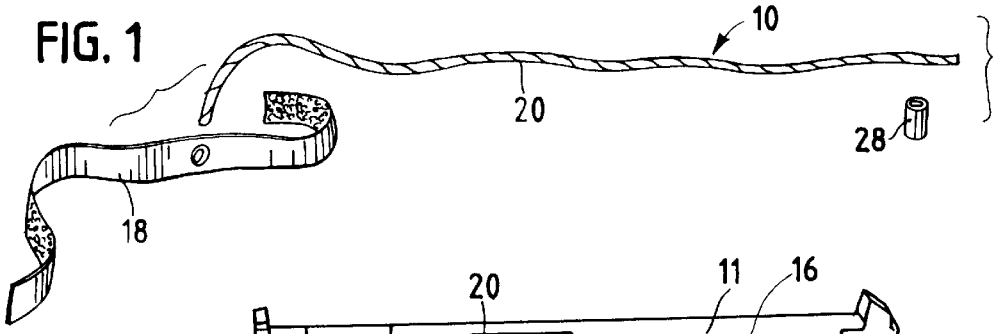
FIG. 2
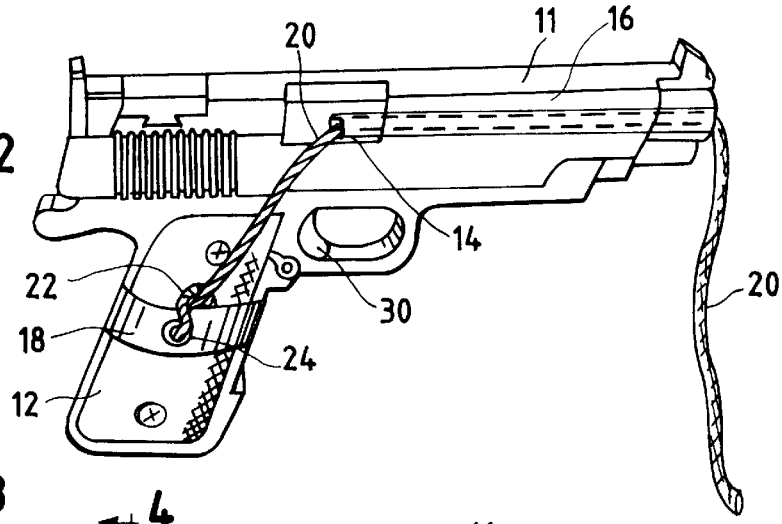
FIG. 3
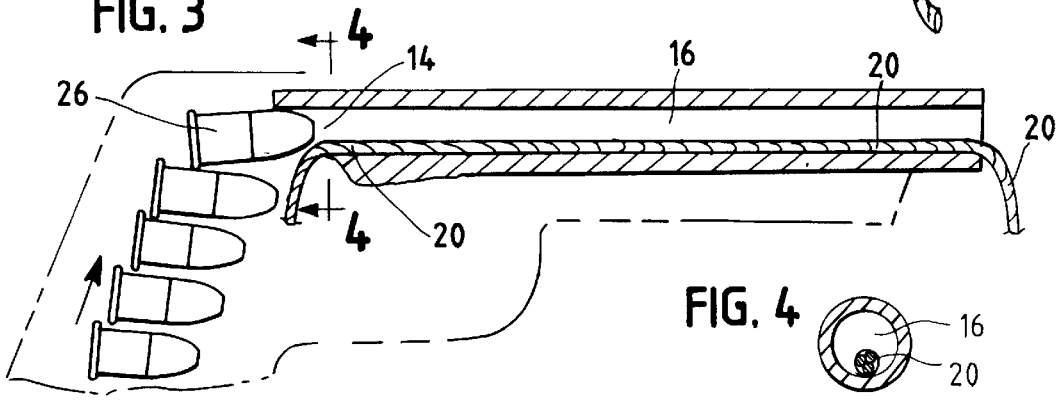
FIG. 4
FIG. 5
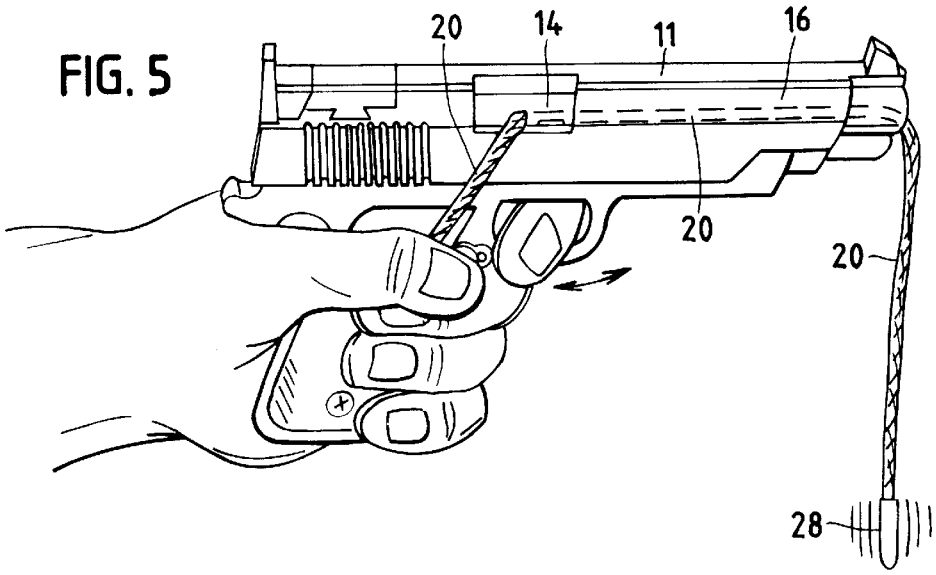

FIG. 6
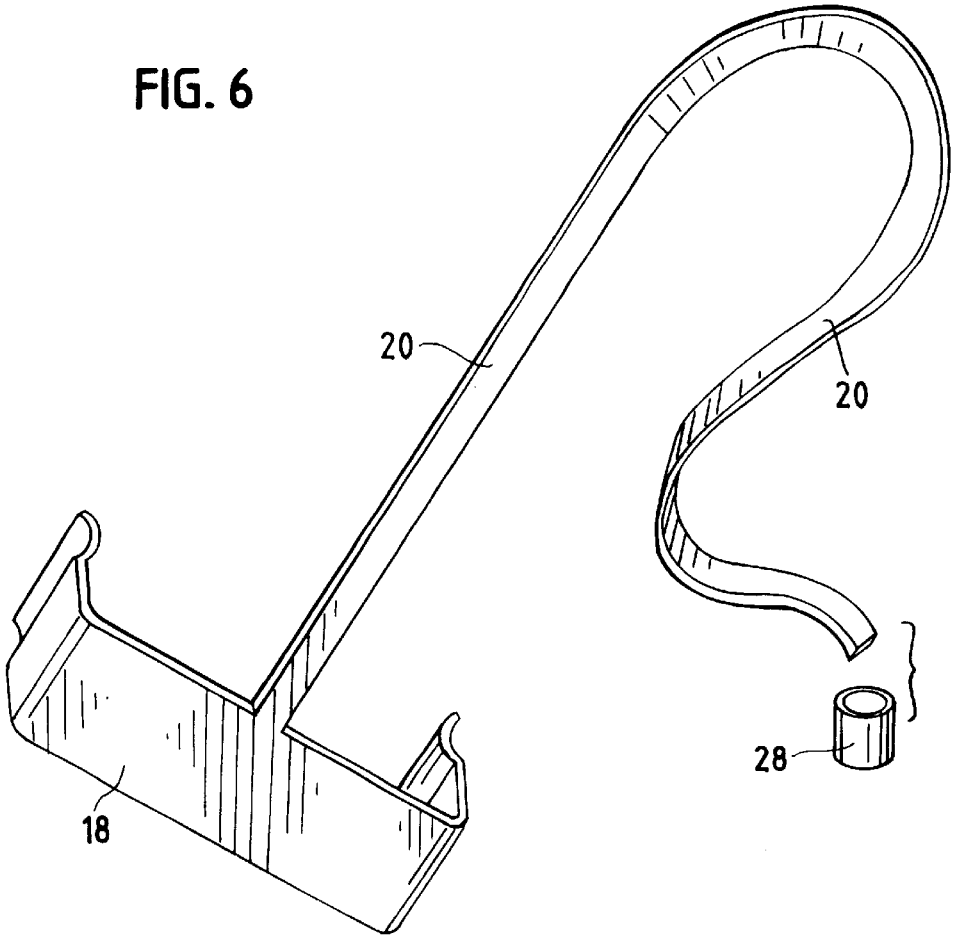
FIG. 7
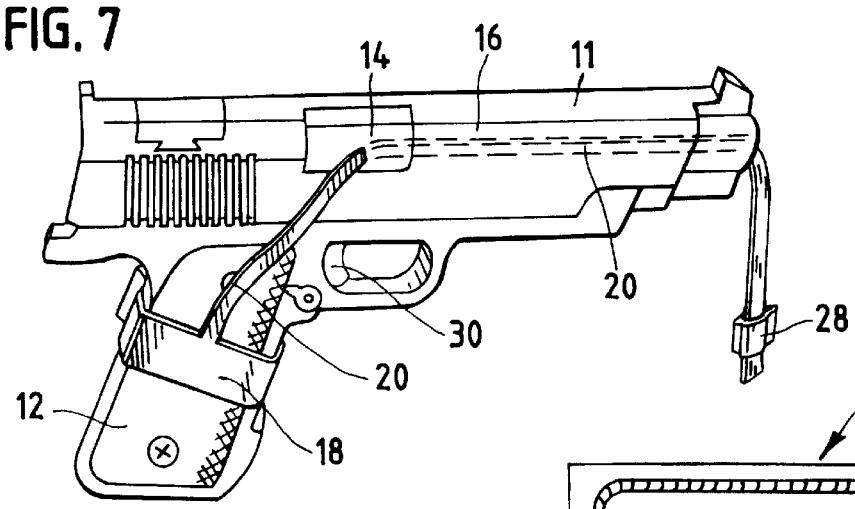
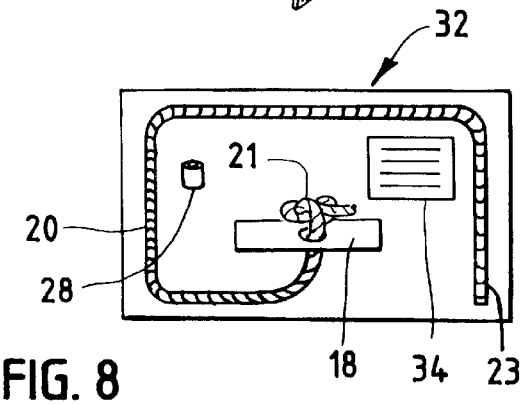
FIG. 8

GUN SAFETY AND MARKSMANSHIP TRAINING DEVICE AND METHOD FOR USING SAME

FIELD OF THE INVENTION

The invention relates generally to firearms and, more particularly to safety and training devices used in conjunction with firearms.

BACKGROUND OF THE INVENTION

In order to maintain proficiency, law enforcement and military personnel are required to undergo initial as well as periodic refresher training involving the use of the firearms that they employ in the normal course of their duties. Despite the numerous safety precaution related to firearms training that have been instituted by both police and military organizations, accidents involving the use of firearms still occur. Often with tragic consequences.

Due to the nature of the work, and in an effort to make training as realistic as possible, it is not possible to conduct some training exercise without using the actual firearms carried by the trainee in the course of performing their duties. Such training exercise may involve, for example hostage rescue scenarios, force employment exercise and various arrests scenarios involving suspect resistance. During these exercise—which do not involve live fire—it is important that the individual conducting the exercise be able to immediately tell if any weapon used in the training is not safe.

Currently, before engaging in any training involving the use of weapons, the first thing that is done is to ensure that all weapons being used are unloaded. While in the majority of cases this step is sufficient to ensure weapons safety, such step offers no visual indication to an instructor that all of the weapons used in a training scenario are indeed safe. Furthermore, the step of unloading one's weapon does not always protect against an accident resulting from a jammed cartridge or the inadvertent chambering of a round. Given the horrific results that arise from accidents involving firearms, a safety device that (1) allows one to immediately recognize that a weapon is safe and (2) prevents the inadvertent firing of a weapon would be an important advancement in the art.

In addition to ensuring firearm safety, it would also be useful to have a device that assists an individual in developing and maintaining control of a weapon during the firing sequence. Currently, trainees undergo what is known as dry firing exercises in an effort to teach them not to anticipate the "pull" of the trigger and discharge of the weapon. Such training is useful in teaching the trainee not to "flinch" or tighten up their muscles when firing the weapon. A device that would ensure that the weapon is safe and, at the same time, allow an instructor and student to see the effect the student's muscular reaction has on the stability of the weapon when it is fired would be an important advancement in the art.

SUMMARY OF THE INVENTION

An object of the invention is to provide a gun safety and marksmanship training device and a method for use that overcome some of the problems and shortcomings of the prior art.

Another object of the invention is to provide a gun safety and marksmanship training device and method that allows for the safe use of guns in a police or military training environment.

Still another object of the invention is to provide a gun safety and marksmanship training device and method that allows one to immediately perceive if a gun is in a safe condition.

Yet another object of the invention is to provide a gun safety and marksmanship training device and method that allows an instructor to identify whether or not a student is flinching during the firing of a weapon.

Another object of the invention involves a safety device for a gun having a handle, a barrel and a chamber. The safety device is comprised of a gun-attachment member capable of being secured to the gun and a chamber-disabling component, that is secured to the gun-attachment.

An additional object of the invention involves a marksmanship training device for use with a gun having a handle, a barrel and a chamber. The marksmanship training device includes a gun-attachment member capable of being secured to the gun, a chamber-disabling component secured to the gun-attachment member and having a portion that extends through the chamber and barrel and out of the barrel, and a weight secured to the portion of the chamber-disabling component positioned out of the barrel.

Another object of the invention involves a method for disabling a gun having a handle, a barrel and a chamber, the method comprising the steps of: (1) attaching a gun-attachment member to the firearm and (2) inserting at least a portion of a chamber-disabling component associated with the gun-attachment member into the chamber.

Another object of this invention involves a method for teaching marksmanship training using a gun having a handle, a chamber and a barrel, the teaching method is comprised of the steps of: (1) attaching a gun-attachment member to the gun; (2) inserting a chamber-disabling component into the chamber such that a portion of the chamber-disabling component extends through the chamber and barrel and out of an end of the barrel; (3) securing a weight to the portion of chamber-disabling component positioned out of the barrel; (4) dry firing the gun; and (5) monitoring movement of the weight attached to the chamber-disabling component.

Finally, another object of this invention also includes a gun-disabling safety kit comprised of a gun-attachment member and a chamber-disabling component.

BRIEF DESCRIPTION OF THE DRAWINGS

FIG. 1 is a perspective view of an embodiment of the gun safety and marksmanship training device;

FIG. 2 is a side elevation view of a gun with the embodiment of the gun safety and marksmanship training device deployed;

FIG. 3 is an enlarged broken away view of FIG. 2 showing the chamber-disabling device blocking the bullet from entering the chamber.

FIG. 4 is a cross section view along line 4—4 of FIG. 3;

FIG. 5 is a side elevation view of the gun and embodiment of the gun safety and marksmanship training device in use of FIG. 2 with a weight secured to the portion of the chamber-disabling device;

FIG. 6 is a perspective view of another embodiment of the gun safety and marksmanship training device;

FIG. 7 is a side elevation view of the other embodiment of the gun safety and marksmanship training device; and FIG. 8 is a plan view of the embodiment of the gun safety and marksmanship training device in a kit.

DETAILED DESCRIPTION OF PREFERRED EMBODIMENTS

Referring now to FIGS. 1 and 2, the invention is shown which involves a safety device 10 for a firearm 11 having a handle 12, a chamber 14 and a barrel 16. The safety device 10 is comprised of a gun-attachment member 18 and a chamber-disabling component 20, that is secured to the gun-attachment 18.

With respect to this invention, the terms "firearm," "gun" and "weapon" are used interchangeably and mean any weapon capable of discharging a bullet upon activation of a trigger mechanism. "Handle" refers to any grip around which the user may place his hand when firing the weapon. Such handles include, but are not limited to, the handle on any well known handgun or the pistol grip included on various shoulder-fired weapons.

In one embodiment of the invention, as shown in FIG. 2, gun-attachment member 18 circumscribes at least a portion of gun handle 12. In a particular, in a version of such embodiment, gun-attachment member 18 is a band, however, the attachment member 18 may be made of any suitable material or structure that allows it to be secured to the firearm. Such structure would include, for example a clamp, as shown in FIGS. 6 and 7, that could be made of any number of materials including plastic or metal. In a more specific version of one embodiment, as seen in FIG. 2, gun-attachment member 18 is made of an elastic material, in particular rubber. The gun-attachment member 18 would be of a florescent color thereby making it immediately visible to anyone involved in the use of the firearm 11 to which it is attached.

The chamber-disabling component 20 of the safety device 10 can also be made of any malleable material including plastic, string, or rubber. The chamber-disabling component 20 is secured to gun-attachment member 18 in any suitable manner including by melting, tying, or shrink wrapping the two together. In FIG. 2, component 20 is secured to gun-attachment member 18 with a knot 22 and additionally secured with shrink wrap 24. Any one or combination of suitable ways may be employed to secure the component 20 and member 18 together. In order to enhance safety, chamber-disabling component 20 would have a fluorescent color.

As shown in FIGS. 2 and 3, the chamber-disabling component 20 is of such a sufficient length that a portion of the component 20 projects from outside the chamber 14 to the inside of the chamber 14 and extends through the chamber 14 and into and through barrel 16. In a more specific version, the component 20 extends from the gun-attachment member 18 through chamber 14 and through and out of barrel 16.

In the operation of the safety device 10, it is seen in FIG. 3, component 20 occupies space within chamber 14 and causes a round 26 from being able to properly position itself in chamber 14, thereby jamming the round 26 and preventing weapon 11 from discharging.

In addition to a safety device, the invention also involves a marksmanship training device for use with gun 11. As shown in FIG. 5, the marksmanship training device includes a gun-attachment member 18, a chamber-disabling component 20 secured to the gun-attachment member 18 and having a portion that extends through the chamber 14 and barrel 16 and out of the barrel 16, and a weight 28 capable of being secured to the portion of the chamber-disabling component 20 that extends out of the barrel 14.

In one embodiment of the marksmanship training device, weight 28 is a plumb bob. In yet another embodiment of the invention, the chamber-disabling component 20 extends through weight 28. The weight 28 may also be florescent in color providing another visual indicator that gun 11 is disabled from being able to be discharged.

The inventive training device, as shown in FIG. 2, gun-attachment member 18 circumscribes the gun handle 12 and is releasably securable thereto. In a specific version of such embodiment, the gun-attachment member 18 is a band. Member 18 is constructed of elastomeric material, in particular rubber although string or plastic is also suitable. Likewise, the chamber-disabling component 20 may also be made of a malleable material such as string, plastic, or rubber.

The gun-attachment member 18 and the chamber-disabling component 20 are secured to each other by any conventional method including, for example, tying, gluing and shrink wrapping, as discussed earlier. As shown in another embodiment, FIG. 6, member 18 and component 20 are manufactured together as an integral component. Both the gun-attachment member 18 and the chamber-disabling component 20 may also be a florescent color.

In FIG. 6, is shown another embodiment of the device 10. In this version the gun-attachment member 18 is a clamp that would be constructed of a resilient material such as plastic or rubber so as to engage and secure itself to handle 12 of gun 11, as seen in FIG. 7.

The safety device is used according to the inventive method for disabling a firearm 11 having a handle 12, a barrel 16 and a chamber 14, the method comprises the steps of: (1) attaching a gun-attachment member 18 to the firearm 11 and (2) inserting at least a portion of a chamber-disabling component 20 associated with the gun-attachment member 18 into the chamber 14. In one embodiment of the inventive method, the gun-attachment member 18 is clamped on the gun 11, as shown in FIG. 7. In still another embodiment, the gun-attachment member 18 circumscribes at least a portion if not all of handle 12 of gun 11.

When using safety device 10 according to the inventive method, the user first attaches the gun-attachment member 18 to the firearm in such a manner that the attachment member 18 is secured to the firearm 11 so as not to fall off once in use. Preferably the gun-attachment member 18 would be attached to the handle 12 of the firearm 11, but the scope of the invention is such that the attachment member 18 may be secured to the weapon 11 in any suitable manner. Ideally, the gun-attachment member 18 would fit substantially flush with the portion of the weapon 11 to which it is attached. Such a fit would allow for use without disturbing the firing technique of the user.

Once the gun-attachment member 18 is secured to weapon 11, the inventive method would include the steps of inserting at least a portion of the chamber-disabling component 20 into the chamber 14. This will prevent any bullet 26 still in the magazine or clip from entering chamber 14. The embodiment of the invention, as shown in FIG. 5, involves extending the chamber-disabling component 20 through the gun barrel 16 and attaching weight 28 to the portion of the chamber-disabling component 20 extending from the barrel 16. It is preferable to extend the length of component 20 to two inches or more beyond the end of barrel 16 for ease in visually observing it. Such weight 28 provides further visual identification that the safety device is in place and that the weapon 11 has been disabled.

The invention also involves a method for teaching marksmanship training using a firearm 10 having a handle 12, a chamber 14 and a barrel 16, the teaching method is comprised of the steps of: (1) attaching a gun-attachment member 18 to the firearm 10; (2) inserting a chamber-disabling component 20 into the chamber 14 such that a portion of the chamber-disabling component 20 extends through the chamber 14 and barrel 16 and out of an end of the barrel 16; and (3) securing a weight 26 to the portion of chamber-disabling component 20 extending from the barrel 16. This method would include as seen in FIG. 5, dry firing the firearm 11 and subsequently monitoring movement of the weight 28 attached to the chamber-disabling component 20 which extends from barrel 16.

Needless to say, firearm 11 is unloaded prior to attaching the gun-attachment member 18.

When learning how to correctly fire weapon 11, it is common for the shooter to anticipate the firing or discharge of the weapon, thereby causing one's muscles to tighten. This tightening results in the shooter "flinching " in anticipation of the pull of the trigger 30 and the discharge of the weapon 11. Such flinching results in movement of the barrel 16 which causes the discharged bullet 26 to miss its intended target.

As a part of marksmanship training it is often useful to have a trainee engage in what is called a dry fire exercise. This exercise involves having the trainee concentrate on pulling the trigger on an unloaded gun 11 while concentrating on holding the barrel 16 steady. Because the dry fire exercise does not involve the use of any ammunition it is sometimes difficult for a trainee to visualize where a bullet 26 would have ended up.

By monitoring the movement of the weight 28 upon the dry firing of the weapon 11, as seen in FIG. 5, both the instructor and the trainee will be able to gauge how much the trainee moved barrel 16 of the gun 11 while anticipating the pull of trigger 30. This will dramatically demonstrate the effect anticipating trigger 30 pull has on the weapon 11 and will allow the trainee to better focus on steadying the gun 11 throughout the firing sequence.

As with the safety device, the weight 28 utilized with the marksmanship training device may also be a plumb bob and may be florescent in color. Furthermore, the chamber-disabling component 20 may extend through the weight 28.

The invention also includes a gun-disabling safety kit 32. As shown in FIG. 1, kit 32 is comprised of a gun-attachment member 18 and a chamber-disabling component 20. In one embodiment of the inventive kit 32, chamber-disabling component 20 has a first end 21 secured to the gun-attachment member 18 and a free second end 23 and the kit also includes a weight 28 capable of being attached to the second end 23 of the chamber-disabling component 20. Such weight 28 may be florescent in color as may be the gun-attachment member 18 and the chamber-disabling component 20.

The gun-attachment member 18 may be a clamp, elastomeric band, or any other suitable material or structure capable of being secured to the weapon 11. Materials suitable for constructing the gun-attachment member 18 and the chamber-disabling component 20 include, but are not limited to, rubber, plastic and string. Operating instructions 34 are also included with the kit 32.

While a detailed description of various embodiments of the invention have been given, it should be appreciated that many variations can be made thereto without departing from the scope of the invention as set forth in the appended claims.

I claim:

1. A safety device far a gun having a handle, a barrel and a chamber, the safety device comprised of:

a gun-attachment member comprising a clamp capable of being secured to a surface of the gun handle; and a chamber-disabling component secured to the gun-attachment member.

2. The safety device of claim 1 wherein the gun-attachment member is adapted to circumscribe the handle of the gun.

3. The safety device of claim 1 wherein the gun-attachment member is a band.

4. The safety device of claim 1 wherein the gun-attachment member is constructed of an elastomeric material.

5. The safety device of claim 4 wherein the elastomeric material includes rubber.

6. The safety device of claim 1 wherein at least a portion of the gun-attachment member is fluorescent in color.

7. The safety device of claim 1 wherein the chamber-disabling component is constructed of a malleable material.

8. The safety device of claim 7 wherein the malleable material is string.

9. The safety device of claim 7 wherein the malleable material is plastic.

10. The safety device of claim 1 wherein the chamber-disabling component is tied to the gun-attachment member.

11. The safety device of claim 1 wherein the chamber-disabling component has a portion adapted to project from the gun-attachment member to inside the chamber.

12. The safety device of claim 11 wherein the portion of the chamber-disabling component is adapted to project beyond the inside of the chamber into the barrel.

13. The safety device of claim 12 wherein the portion of the chamber-disabling component is adapted to project through a length of the barrel.

14. The safety device of claim 1 wherein the chamber-disabling component is secured to the gun-attachment member with shrink wrap positioned about a portion of the gun-attachment member and a portion of the chamber-disabling component.

15. The safety device of claim 1 wherein the gun-attachment member is integral with the chamber-disabling component.

16. A marksmanship training device for use with a gun having a handle, a barrel and a chamber, the marksmanship training device comprised of:

a gun-attachment member capable of being secured to the gun;

a chamber-disabling component secured to the gun-attachment member and having a portion adapted to extend through the chamber and barrel and out of the barrel; and a weight securable to the portion of the chamber-disabling component adapted to extend out of the barrel, wherein the weight is suspended from a single point of the chamber-disabling component and is capable of being monitored to gauge whether a marksmanship trainee moved the barrel of the gun before firing.

17. The marksmanship training device of claim 16 wherein the weight is a plumb bob.

18. The marksmanship training device of claim 16 wherein the weight is florescent in color.

19. The marksmanship training device of claim 16 wherein the chamber-disabling component extends through the weight.

20. The marksmanship training device of claim 16 wherein the gun-attachment member is capable of being secured to the gun handle.

21. The marksmanship training device of claim 16 wherein the gun-attachment member is a band.

22. The marksmanship training device of claim 16 wherein the gun-attachment member is a clamp.

23. The marksmanship training device of claim 16 wherein the gun-attachment member is constructed of elastomeric material.

24. The marksmanship training device of claim 23 wherein the elastomeric material is rubber.

25. The marksmanship training device of claim 16 wherein at least a portion of the gun-attachment member is florescent in color.

26. The marksmanship training device of claim 16 wherein the chamber-disabling component is made of a malleable material.

27. The marksmanship training device of claim 26 wherein the malleable material is a string.

28. The marksmanship training device of claim 26 wherein the malleable material is plastic.

29. The marksmanship training device of claim 16 wherein the chamber-disabling component is tied to the gun-attachment member.

30. The marksmanship training device of claim 16 wherein the chamber-disabling component is secured to the gun attachment member with shrink wrap positioned about a portion of the chamber-disabling component and a portion of the gun-attachment member.

31. The marksmanship training device of claim 16 wherein the gun-attachment member is integral with the chamber-disabling component.

32. The marksmanship training device of claim 16 the disabling component is adapted to extend from the gun-attachment member through the chamber and down the interior of the barrel to outside the barrel.

33. The marksmanship training device of claim 32 wherein the disabling component is adapted to extend out of the barrel at least two inches.

34. A method for disabling a gun having a handle, a barrel and chamber, the method includes the steps of:

attaching a gun-attachment member to the handle of the gun; and inserting at least a portion of a chamber-disabling component associated with the gun-attachment member into the chamber.

35. The method of claim 34 wherein the step of attaching the gun-attachment member to the gun includes the step of clamping a clamp member to the handle of the gun.

36. The method of claim 35 wherein the step of attaching the gun-attachment member to the gun includes the step of providing an elastomeric member and positioning the elastomeric member circumscribe the handle of the gun.

37. The method of claim 34 including the step of securing the gun-attachment member and the chamber-disabling component together.

38. The method of claim 37 wherein the step of securing includes the step of tying the gun-attachment member together.

39. The method of claim 37 wherein the step of securing includes the step of positioning shrink wrap about a portion of the gun-attachment member and a portion of the chamber-disabling component.

40. The method of claim 34 including the step of providing the gun-attachment member having at least a portion in a florescent color.

41. The method of claim 34 in which the step of inserting at least a portion of the chamber disabling component into the chamber includes further inserting the component through the chamber and through the barrel of the gun.

42. The method of claim 41 in which the step of further inserting includes moving the component to extend out of the barrel.

43. The method of claim 42 further including securing a weight to a portion of the component that extends out of the barrel.

44. The method of claim 43 further including providing a plumb bob for the weight.

45. The method of claim 43 further including providing a weight having at least a portion being a fluorescent color.

46. The method of claim 34 further including providing the chamber-disabling constructed of a malleable material.

47. The method of claim 46 further including providing the component constructed of string.

48. The method of claim 46 further including providing the component constructed of plastic.

49. A method for teaching marksmanship training using a gun having a handle, a chamber and a barrel includes the steps:

attaching a gun-attachment member to the gun;

inserting a chamber-disabling component into the chamber such that a portion of the chamber-disabling component extends through the chamber and barrel and out of an end of the barrel; and providing a weight secured to the portion of chamber-disabling component which extends out of the barrel.

50. The method of claim 49 including the step of dry firing the gun.

51. The method of claim 49 including the step of monitoring the movement of the chamber-disabling component.

52. The method of claim 49 further comprising the step of unloading the gun prior to attaching the gun-attachment member.

53. The method of claim 49 further comprising the steps of:

providing an elastomeric band for the gun-attachment member; and positioning the band to engage the handle of the gun.

54. The method of claim 49 further comprising the steps of:

providing a clamp for the gun-attachment member; and positioning the clamp to engage the handle of the gun.

55. The method of claim 49 further including providing the chamber-disabling component constructed of a malleable material.

56. The method of claim 49 further including providing the chamber-disabling component constructed of string.

57. The method of claim 49 including the step of extending the chamber-disabling component to extend at least 2 inches of the barrel.

58. The method of claim 49 including the step of providing at least part of the weight to be fluorescent in color.

59. The method of claim 49 including the step of providing at least part of the gun-attachment member to be fluorescent in color.

60. A gun disabling kit comprising:

a gun-attachment member capable of being secured to a gun handle; and a chamber-disabling component; and a weight capable of being attached to a portion of the chamber disabling component, wherein the weight is suspended from a single point of the chamber-disabling component and is capable of being monitored to gauge whether a marksmanship trainee moved the barrel of the gun before firing.

61. The gun-disabling kit of claim 60 wherein the weight is fluorescent in color.

62. The gun-disabling kit of claim 60 wherein the gun-attachment member is fluorescent in color.

63. The gun-disabling kit of claim 60 wherein the gun-attachment member is a clamp.

64. The gun-disabling kit of claim 60 wherein the gun-attachment member is an elastomeric band.

65. The gun-disabling kit of claim 64 wherein the elastomeric band is made of rubber.

66. The gun-disabling kit of claim 60 wherein the gun-attachment member and the chamber-disabling component are secured to one another.

67. The gun-disabling kit of claim 66 wherein the chamber-disabling component is made of a malleable material.

68. The gun-disabling kit of claim 67 wherein the malleable material is a string.

69. The gun-disabling kit of claim 60 further including operating instructions.

70. The gun-disabling kit of claim 60 wherein the chamber-disabling component is adapted to extend through a chamber and a barrel of a gun.

71. The gun-disabling kit of claim 70 wherein the chamber-disabling component is adapted to extend at least 2 inches beyond the barrel of the gun.

72. A marksmanship training device for use with a gun having a handle, a barrel and a chamber, the marksmanship training device comprised of:

a gun-attachment member capable of being secured to the gun;

a chamber-disabling component secured to the gun-attachment member; and a weight secured to a portion of the chamber-disabling component.

* * * * *

UNITED STATES PATENT AND TRADEMARK OFFICE

CERTIFICATE OF CORRECTION

PATENT NO. : 6,626,674 B2
DATED : September 30, 2003
INVENTOR(S) : Jeffery L. Chudwin It is certified that error appears in the above-identified patent and that said Letters Patent is hereby corrected as shown below:

Column 1,
Line 16, change “precaution” to -- precautions --.
Lines 22, 24, 25 and 27, change “exercise” to -- exercises --.
Line 24, insert -- , -- after “example”.

Column 5,
Line 66, change “far” to -- for --.

Column 7,
Line 29, insert -- wherein -- between “16” and “the”.
Line 49, insert -- to -- between “member” and “circumscribe”.

Column 8,
Line 47, insert -- out -- between “inches” and “of”.

Column 9,
Line 10, change “66” to -- 60 --.

Signed and Sealed this

Third Day of February, 2004

JON W. DUDAS
*Acting Director of the United States Patent and Trademark Office*